US005597996A

United States Patent [19]

Flood

[11] Patent Number: 5,597,996

[45] Date of Patent: Jan. 28, 1997

[54] CASH DISPENSING APPARATUS (ATM) AND METHOD FOR SEPARATING REJECTED BANK NOTES

[75] Inventor: Dennis Flood, Dundee, Scotland

[73] Assignee: NCR Corporation, Dayton, Ohio

[21] Appl. No.: 633,237

[22] Filed: Apr. 16, 1996

[30] Foreign Application Priority Data

Nov. 16, 1995 [GB] United Kingdom ..... 9523378

[51] Int. Cl.[6] ..... G07G 1/10; G07G 1/12

[52] U.S. Cl. ..... 235/379; 902/14

[58] Field of Search ..... 235/379, 380, 235/381, 375; 902/8, 9, 10, 11, 12, 13; 271/58.01, 58.23

[56] References Cited

U.S. PATENT DOCUMENTS 4,434,359 2/1984 Watanabe ..... 235/379
4,456,234 6/1984 Simonotti ..... 270/18
4,463,939 8/1984 Watanabe ..... 270/1.1
5,335,484 8/1994 Hain ..... 53/582

FOREIGN PATENT DOCUMENTS 49306 6/1993 Japan ..... 235/379

*Primary Examiner*—Donald T. Hajec
*Assistant Examiner*—Douglas X. Rodriguez
*Attorney, Agent, or Firm*—Michael Chan

[57] ABSTRACT

The invention relates to a cash dispensing apparatus having a purge bin (84) into which bank notes (24) may be deposited as a result of an irregularity in the picking or transportation of the notes or as a result of a user failing to remove all of the notes. The invention is characterized by depositing a separating sheet (25) in the purge bin (84) subsequent to each purge operation for the purpose of separating the bank note or notes (24) deposited in the purge bin (84) in one purge operation from the note or notes (24) deposited in the purge bin (84) in the next purge operation.

10 Claims, 3 Drawing Sheets

CASH DISPENSING APPARATUS (ATM) AND METHOD FOR SEPARATING REJECTED BANK NOTES

BACKGROUND OF THE INVENTION

This invention relates to a cash dispensing apparatus.

The invention relates in particular to a cash dispenser unit of an automated teller machine (ATM). As is well known, in operation of an ATM a user inserts a customer identifying card into the machine and then enters certain data (such as codes, quantity of currency required, type of transaction, etc.) upon one or more keyboards included in a user console of the machine. The machine will then process the transaction, update the user's account to reflect the current transaction, dispense cash, when requested, from one or more currency cassettes mounted in the machine, and return the card to the user as part of a routine operation.

A known cash dispenser unit of an ATM includes at least one note picking mechanism for extracting notes one by one from an associated currency cassette, stacking means for accumulating the extracted notes into a stack, and transport means for feeding the stack of notes to a delivery port or exit slot in the ATM from where the stack may be removed by a user of the ATM. If for any reason it is determined that the stack of notes is to be rejected, for example as a result of a multiple note detect mechanism having detected in the course of a stack operation that two or more notes have been picked in a single pick operation, then instead of feeding the stack to the exit slot the transport mechanism feeds the stack into a rejected note container (purge bin). In operation of this known dispenser unit, another situation where a purge operation takes place is where a user of the ATM fails to remove some or all of the notes presented to him in response to a cash withdrawal request. Thus, if a determination is made that one or more notes remain present at the exit slot for more than a predetermined period of time, then the transport means is operated so as to feed the uncollected note(s) from the exit slot into the purge bin.

A disadvantage of the known cash dispenser referred to above is that, since both rejected notes and uncollected notes are deposited in the same purge bin, it may be difficult to identify any particular notes in the purge bin in the event of a dispute occurring between a customer and a bank concerning possible failure by the customer to remove some or all of a stack of notes presented to him in response to a cash withdrawal request.

A further known cash dispenser unit of an ATM includes separate collection means for rejected notes and for notes which have been left uncollected by a customer. However, this further known unit has the advantage that the provision of such separate collection means adds to the complexity and cost of the unit. Another disadvantage of this further known unit is that it may not be possible to distinguish with certainty purged notes left uncollected by one user from purged notes left uncollected by another user.

SUMMARY OF THE INVENTION

It is the object of the invention to provide a cash dispenser apparatus suitable for alleviating the above-mentioned disadvantages of known cash dispensers.

According to a first aspect of the present invention there is provided a cash dispensing apparatus including a purge bin into which one or more bank notes are deposited in the course of a purge operation, characterized by storage means for storing sheets other than bank notes, and sheet handling means arranged to withdraw a sheet from said storage means and to deposit this sheet in said purge bin subsequent to a purge operation, thus separating from each other the note deposits made in said purge bin in successive purge operations.

According to a second aspect of the present invention, there is provided a method of purging bank notes in a cash dispensing apparatus in which one or more bank notes are deposited in a purge bin in the course of a purge operation, characterized by depositing a separating sheet in said purge bin subsequent to each purge operation for the purpose of separating from each other the note deposits made in said purge bin in successive purge operations.

It is an advantage of the present invention that bank note deposits made in a purge bin in the course of separate purge operations can be separately identified, which is of substantial value to the financial institution operating the ATM which incorporates the purge bin.

It is a second advantage of the present invention that the invention may be utilized without physically altering existing ATMs.

BRIEF DESCRIPTION OF THE DRAWINGS

An embodiment of the present invention will now be described, by way of example, with reference to the accompanying drawings in which.

DETAILED DESCRIPTION

Figure 1:
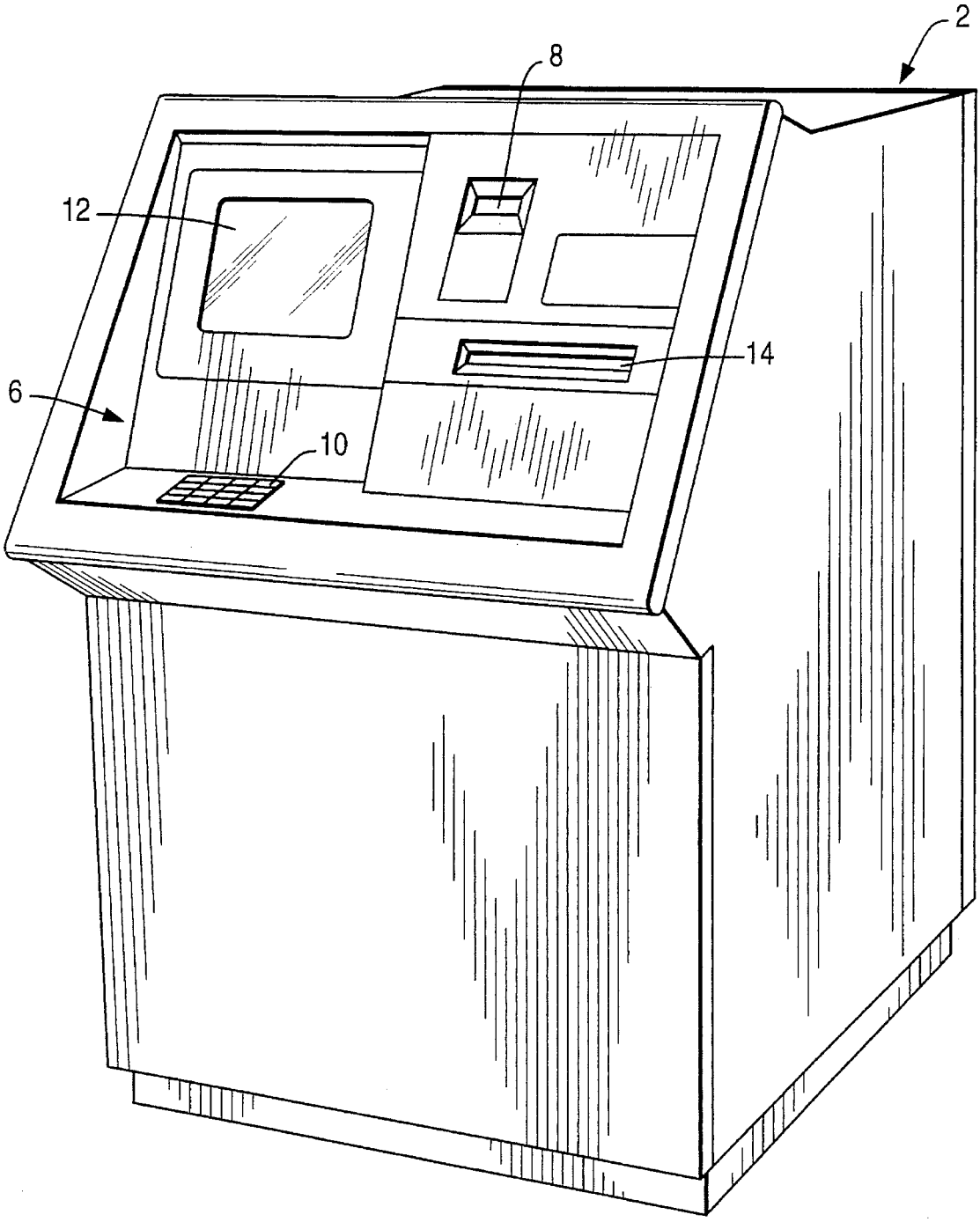
FIG. 1 is a perspective view of an ATM having a cash dispenser unit in accordance with the present invention.
Figure 2:
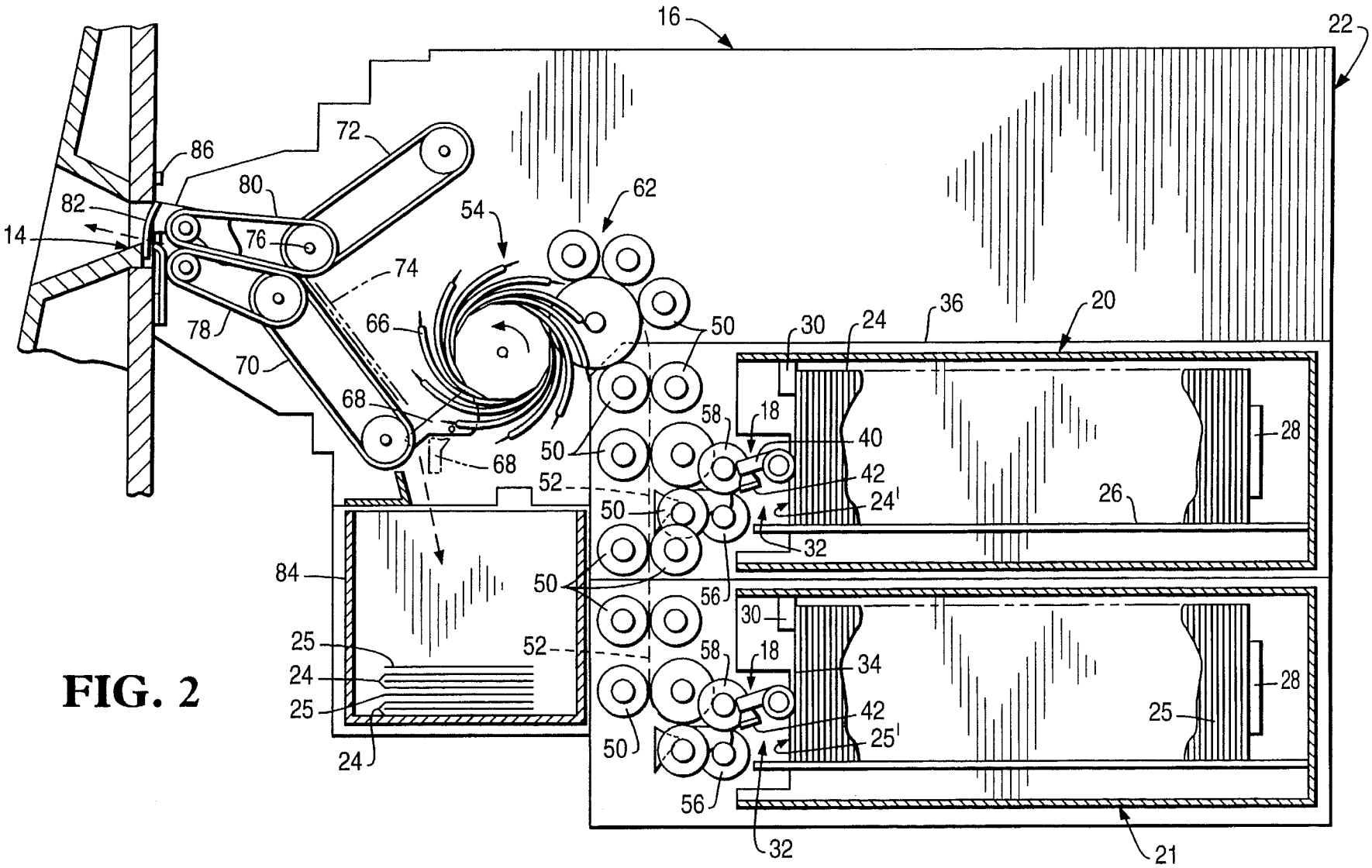
FIG. 2 is a side elevational view of the cash dispenser unit of the ATM of FIG. 1, the dispenser unit having two pick means, and parts of said unit being omitted.
Figure 3:
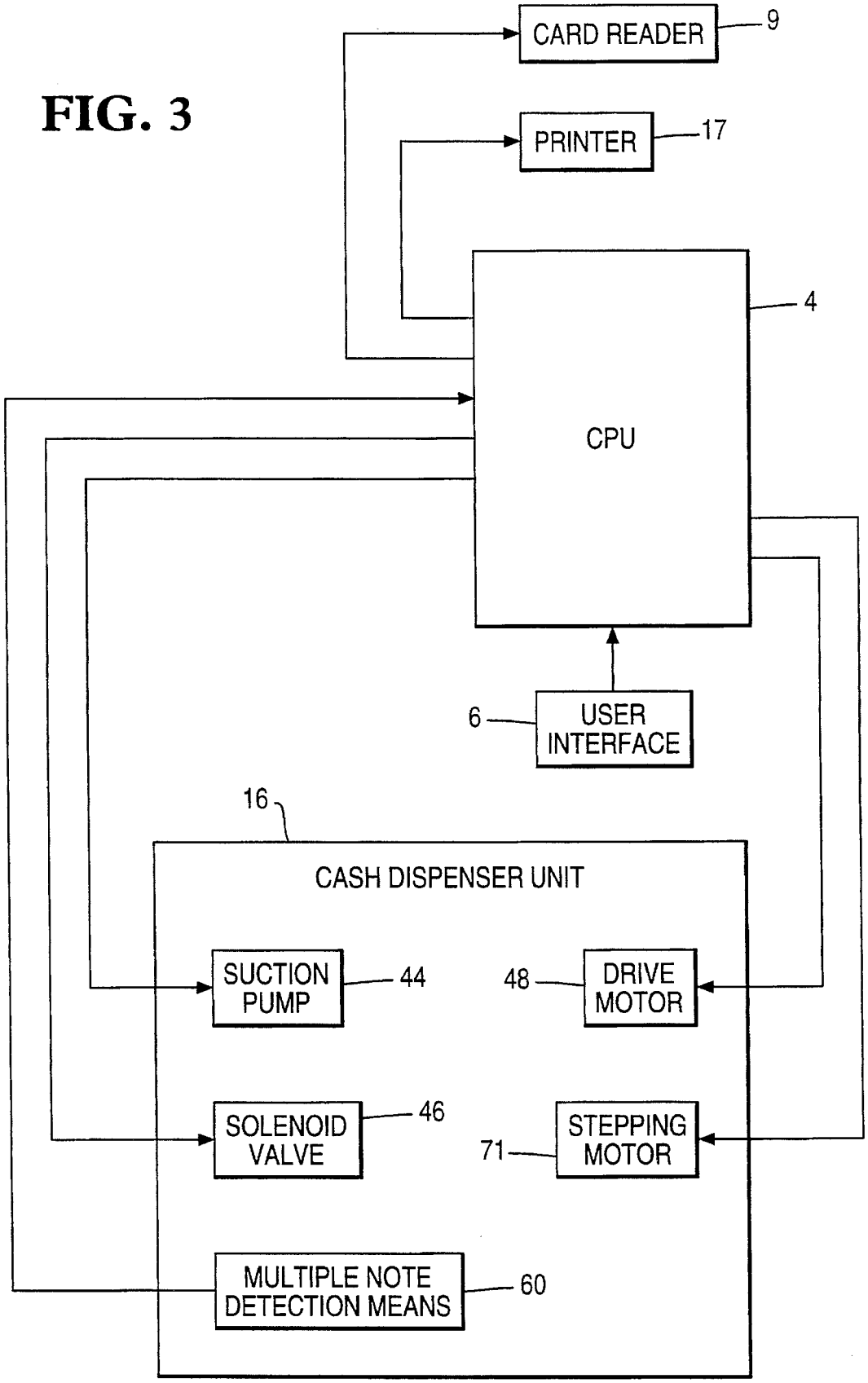
FIG. 3 is a block circuit diagram of elements of the ATM of FIG. 1.

With reference to FIGS. 1, 2 and 3 there is illustrated a conventional ATM 2 having a cash dispenser unit 16, which is operable in accordance with the method of the present invention. The ATM 2 incorporates an electronic control means in the form of a central processor unit (CPU) 4 which has stored therein a control program which controls the operation of the ATM 2.

The CPU 4 is connected to a user interface device 6 incorporating a slot 8 (FIG. 1), associated with a conventional card reader 9 (FIG. 3), for receiving a user identity card, a key pad 10 for inputting data, a screen 12 for displaying user information, and an output slot 14 through which bank notes are dispensed to a user. The CPU 4 is also connected to the cash dispenser unit 16 (FIG. 2) and a conventional printer 17 (FIG. 3) for printing documents such as statements, receipts and account balances.

The CPU 4 in addition to controlling the operation of the ATM 2 also maintains a transaction journal which notes sequentially the account details for each user of the ATM, the details of each transaction requested of the ATM and the result of that transaction, i.e. cash dispensed successfully or cash purged. The transaction journal can be stored electronically or can take the form of a printed record.

Referring particularly to FIG. 2, the cash dispenser unit 16 includes two similar known pick means 18 arranged one above the other and respectively associated with an upper storage cassette 20 and a lower storage cassette 21, which are in the form of conventional currency cassettes and which are removably mounted in a supporting framework 22 of the dispenser unit 16. The upper storage cassette 20 is arranged to contain a stack of bank notes 24, while the lower cassette 21 contains a stack of rectangular paper sheets 25 (hereinafter referred to as audit sheets), corresponding long edges of both the bank notes 24 and the audit sheets 25 being supported on a horizontal support plate 26 mounted in each of the storage cassettes 20,21.

It should be understood that the ATM 2 would normally include a plurality of storage cassettes containing bank notes of different denominations, thus enabling flexibility in the quantity of cash dispensed by the ATM 2. However, for simplicity only one cassette containing bank notes and one cassette containing audit sheets is illustrated in FIG. 2.

Both cassettes 20,21 are similar, as is the operation, under the control of the CPU 4, to pick a bank note 24 from the upper cassette 20 and to pick an audit sheet 25 from the lower cassette 21. Therefore, only the upper cassette 20, and the operation to pick a bank note 24 therefrom will be described in detail.

The stack of notes 24 in the upper storage cassette 20 is urged by a spring loaded pusher member 28 towards a stop member 30 mounted at the front end of the storage cassette 20. An opening 32 is formed in the front end of the storage cassette 20, the opening 32 being closed normally by conventional shutter means (not shown) when the storage cassette 20 is not mounted in the dispenser unit 16. When a storage cassette 20 is mounted correctly in the dispenser unit 16, the shutter is automatically retracted to enable notes 24 to be extracted through the opening 32 by the associated pick means 18.

As is well known, the pick means 18 includes two conventional pick arms 40, each incorporating a rubber suction pad 42, which are pivotably mounted with respect to the framework 22 of the cash dispenser unit 16. In operation, a suction force produced by a suction pump 44 (FIG. 3) is applied to a first note 24' in the stack of notes 24 in the upper storage cassette 20 via the suction pads 42, when the suction pads 42 are in contact with the first note 24' and a solenoid valve 46 (FIG. 3) located between the suction pump 44 and the suction pads 42 is opened. An oscillatory movement of the pick arms 40 is effective to cause notes 24 to be picked one by one from the stack of notes 24 held in the storage cassette 20. The dispenser unit 16 also incorporates feed rollers 50 for feeding the bank notes 24 along a feed path 52 from the upper storage cassette 20 to a conventional stacking wheel 54 and on to the output slot 14, the rollers 50 being associated with co-operating first and second rollers 56 and 58 which are positioned at the opening 32 in the front of the storage cassette 20.

In the course of a normal pick operation, the lower long edge of the first bank note 24' of the stack of notes 24 in the upper storage cassette 20 is pulled partly out of the storage cassette 20 under the suction force applied by the respective suction pads 42, and is fed between the associated first and second rollers 56,58. As the rollers 56,58 engage the bank note 24' they urge the note 24' into the feed path 52 for feeding by the rollers 50.

The stacking wheel 54 is arranged in known manner to receive notes 24 fed along the feed path 52. The stacking wheel 54 serves to stack notes 24 picked from the storage cassette 20 so as to form a bundle 74 of notes for delivery to the output slot 14 for collection by the user.

The stacking wheel 54 is driven by a drive motor 48 (FIG. 3) and is arranged to rotate continuously in operation in a counter clockwise direction. Multiple note detection means 60 (FIG. 3) are provided between an upper transport mechanism 62 and the stacking wheel 54 for detecting any multiple feeding of notes. In operation, each note fed along the feed path 52 to the stacking wheel 54 enters between adjacent tines 66 and is carried partly around the axis of the stacking wheel 54, the note being stripped from the wheel 54 by a stripper plate assembly 68 and being stacked against belt means 70. The belt means 70 co-operates with belt means 72 normally held in the position shown in FIG. 2. When the bundle of notes 74 (or possibly a single note only) to be dispensed to a user, in response to a cash withdrawal request, has been stacked against the belt means 70, the belt means 72 is rocked in a clockwise direction about a shaft 76 so as to trap the bundle 74 of notes between the belt means 70 and the belt means 72. It should be understood that in the course of this rocking movement separate belts making up the belt means 72 pass between adjacent pairs of the stacking plates 64.

Assuming that none of the notes 24 in the bundle 74 have been rejected for any reason, the belt means 70 and 72 are operated so as to drive the bundle 74 to an adjacent pair of belt means 78 and 80. The belt means 78 and 80 serve to drive the bundle 74 partially through the output slot 14 to a position where the bundle 74 can be collected by the user of the ATM 2, a shutter 82, which serves to close the slot 14 when the ATM is note in operation, having previously been retracted to an open position.

It should be understood that the belt means 70 and 72 are mounted in resilient relationship relative to each other, and the belt means 78 and 80 are also mounted in resilient relationship relative to each other, so that bundles of notes of varying thickness can be held between, and fed by, the belt means 70 and 72 and the belt means 78 and 80.

The belt means 70, 72, 78 and 80 are driven under the control of the CPU 4 by a bi-directional stepping motor 71 (FIG. 3).

If a multiple feeding has been detected in the course of stacking the bundle of notes 74 against the belt means 70, or if one or more of the notes in the bundle 74 have been rejected for any other reason, then the stripper plate assembly 68 is rocked into the position shown in chain outline in FIG. 2, and the belt means 70 and 72 are operated to feed the bundle 74 in a direction opposite to the normal feed direction, the bundle 74 being deposited in a purge bin 84 via an opening in the top thereof.

Likewise, when a bundle 74 of notes 24 has been presented at the output slot 14 for a predetermined time, and all or part of the bundle 74 has not been removed, as detected by a sensor 86 located adjacent the output slot 14, then the bundle 74, or remainder thereof, is retracted, by the bi-directional stepping motor 71 urging the belts 78,80 in the opposite direction to the normal feed direction, the note or notes making up the bundle 74 or remainder thereof being deposited in the purge bin 84, as described above.

Immediately after a purge operation has taken place as described above, and before any further cash withdrawal operation takes place, the CPU 4 instructs the pick means 18 associated with the lower storage cassette 21 to pick the first audit sheet 25' from the lower cassette 21, and actuates the drive motor 48 which causes the feed rollers 50 to transport the sheet 25 from the lower cassette 21 to the stacking wheel 54, in the same manner as the aforementioned bank notes 24 are picked and transported. From the stacking wheel 54 the audit sheet 25' is deposited in the purge bin in the same manner as that in which one or more bank notes are deposited in the purge bin 84 as a result of an irregularity in the picking or transportation of the notes to the belts 70 and 72. It should be understood that bank notes 24 and audit sheets 25 are deposited by the belts 70 an 72 in the purge bin 84 in a controlled manner so that, in the course of successive purge operations, the bank note or notes deposited in the purge bin 84 in the course of each purge operation other than the last is separated by an audit sheet from the bank note or notes deposited in the purge bin 84 in the course of the next purge operation.

If bank notes 24 are purged due to an irregularity in the picking or transportation of the notes 24, the ATM 2 will then re-pick the desired notes, which are then transported to the output slot 14 in the normal manner, assuming no irregularity has occurred. If notes 24 are purged due to the failure of a user to remove the notes 24 from the output slot 14 then the ATM 2 will await a request from a new user.

The audit sheets 25 may have certain identifying information different for each sheet, printed on them, such as consecutive numbers. By virtue of the information contained in the ATM journal referred to above each separate bundle of bank notes in the purge bin 84 can be allocated to a particular transaction which has recorded a cash purge. This allocation is simplified by the use of identifying information on the audit sheets.

What is claimed is:

1. A cash dispensing apparatus for dispensing bank notes, the cash dispensing apparatus comprising:

a purge bin into which one or more bank notes are deposited in the course of a purge operation;

storage means for storing sheets other than bank notes; and sheet handling means for withdrawing a sheet from the storage means and depositing this sheet in the purge bin subsequent to a purge operation to separate from each other the note deposits made in the purge bin in successive purge operations.

2. An apparatus according to claim 1, further comprising at least one currency storage cassette for storing a stack of bank notes to be dispensed.

3. An apparatus according to claim 2, wherein the storage means includes a storage cassette for storing a plurality of the sheets, the storage cassette operating in the same manner as the at least one currency storage cassette.

4. An apparatus according to claim 3, further comprising electronic control means for maintaining a transaction journal including details of each transaction carried out by the cash dispensing apparatus such that each separate bundle of bank notes deposited in the purge bin can be cross referenced to an individual entry in the transaction journal.

5. A cash dispensing apparatus for dispensing bank notes, the cash dispensing apparatus comprising:

a purge bin into which one or more bank notes are deposited in the course of a purge operation;

a storage cassette for storing sheets other than bank notes; and a sheet handling mechanism for withdrawing a sheet from the storage cassette and depositing this sheet in the purge bin subsequent to a purge operation to separate from each other the note deposits made in the purge bin in successive purge operations.

6. An apparatus according to claim 5, further comprising at least one currency storage cassette for storing a stack of bank notes to be dispensed.

7. An apparatus according to claim 6, wherein the storage cassette operates in the same manner as the at least one currency storage cassette.

8. An apparatus according to claim 5, further comprising electronic control means for maintaining a transaction journal including details of each transaction carried out by the cash dispensing apparatus such that each separate bundle of bank notes deposited in the purge bin can be cross referenced to an individual entry in the transaction journal.

9. A method of purging bank notes in a cash dispensing apparatus, the method comprising the steps of:

depositing one or more bank notes in a purge bin in the course of a purge operation; and depositing a separating sheet in the purge bin subsequent to each purge operation for the purpose of separating from each other the note deposits made in the purge bin in successive purge operations.

10. A method according to claim 9, wherein each separating sheet deposited in the purge bin carries identifying information which is different for each sheet.

* * * * *